US010456698B2

(12) United States Patent
Chen et al.

(10) Patent No.: US 10,456,698 B2
(45) Date of Patent: Oct. 29, 2019

(54) TOY VEHICLE WITH NOVEL DRIVE-TRAIN CONTROL ASSEMBLY

(71) Applicant: Goldlok Toys Holdings (Guangdong) Co. Ltd., Kowloon (HK)

(72) Inventors: Wei Chen, Puning (CN); Chi Wai Chiu, Kowloon (HK)

(73) Assignee: Goldlok Holdings (Guangdong) Co. Ltd., Kowloon (HK)

( * ) Notice: Subject to any disclaimer, the term of this patent is extended or adjusted under 35 U.S.C. 154(b) by 42 days.

(21) Appl. No.: 15/597,230

(22) Filed: May 17, 2017

(65) Prior Publication Data

US 2018/0333650 A1 Nov. 22, 2018

(51) Int. Cl.
*A63H 29/00* (2006.01)
*A63H 29/22* (2006.01)

(52) U.S. Cl.
CPC ..... *A63H 29/22* (2013.01)

(58) Field of Classification Search
CPC ..... A63H 17/00; A63H 17/25; A63H 30/00
USPC ..... 446/454
See application file for complete search history.

(56) References Cited

U.S. PATENT DOCUMENTS

| | | | | |
|---|---|---|---|---|
| 4,306,375 | A | 12/1981 | Goldfarb et al. | |
| 4,540,380 | A | 9/1985 | Kennedy et al. | |
| 4,591,347 | A | 5/1986 | Goldfarb et al. | |
| 4,684,355 | A | 8/1987 | Urakawa et al. | |
| 6,089,952 | A | 7/2000 | Dowd et al. | |
| 6,371,830 | B1 * | 4/2002 | Wu | A63H 17/262 446/457 |
| 7,128,634 | B2 * | 10/2006 | Ogihara | A63H 17/262 446/456 |
| 7,204,330 | B1 | 4/2007 | Lauren | |
| 8,668,546 | B2 * | 3/2014 | Rudell | A63H 17/00 446/454 |

* cited by examiner

*Primary Examiner* — Raeann Gorden
(74) *Attorney, Agent, or Firm* — D. Tiller Law PLLC; Donald Tiller

(57) ABSTRACT

A toy vehicle with a selectively engageable gear assembly is disclosed. The gear assembly may be selectively placed in a drive position in which a first set of wheels and a second set of wheels are connected to the motor through a first gear train and a second gear train, respectively. The gear assembly may be selectively placed in a freewheel position in which the first set and second set of wheels are disconnected from the motor. The gear assembly is switched from the drive position to the freewheel position using a lever that pivots to move a gear in the first gear train to disconnect the gear and break the first gear train when a gear is moved in the second gear train to disconnect the gear and break the second gear train. Through the lever, the first and second gear trains are positioned in concert.

11 Claims, 12 Drawing Sheets

TOY VEHICLE WITH NOVEL DRIVE-TRAIN CONTROL ASSEMBLY

BACKGROUND

This invention generally pertains to technology for automatically setting a motor-driven toy vehicle to four-wheel-drive mode when the toy is powered on and to freewheel mode when the toy is powered off.

Motor-driven toy vehicles are often of limited use because the motor is always engaged with the wheels. The toy is useful when power is available and the wheels move as directed. When power is not available, however, the motor resists movement of the vehicle's wheels. Thus, it is difficult to push the vehicle when powered off and pushing the vehicle may damage the motor, the wheels, or the gear train(s) connecting the motor to the wheels.

There are various approaches to selectively disengaging the motor from the gear train(s) or the gear train(s) from the wheels to enable a freewheel mode of operation. A novel approach is described and claimed herein.

SUMMARY

The present invention is directed to a drive-train technology for switching a toy vehicle into and out of a freewheel mode.

In one aspect of the invention, a toy vehicle includes a chassis, and electric motor, front and back wheel assemblies, and a controllable drive train connecting the motor to the wheel assemblies. The drive train includes a front gear train and a rear gear train. The front gear train includes a series of gears that selectively mesh with a motor gear on one end and with a gear on the front wheel assembly on the other end. The rear gear train includes a series of gears that selectively mesh with a motor gear on one end and with a gear on the rear wheel assembly on the other end. Rotation of the motor gear(s), when meshed with the front gear train and the rear gear train, cause the gears of the trains to rotate which causes the wheel gears to rotate which cause the wheels to rotate. The drive train includes a mode-selector lever that in a first position causes one of the gears of one of the front or rear gear trains to mesh with the motor gear(s) and in a second position causes one of the gears of one of the front or rear gear trains to disengage from the motor gear(s). The drive train includes a mode-selector switch that in a first position causes on of the rear or front gear trains to mesh with the motor gear(s) and in a second position causes one of the gears of the rear or front gear trains to disengage from the motor gear(s). The mode-selector lever and the mode-selector switch coordinate such that the front and rear gear trains are both meshed with the motor gear(s) or both disengaged from the motor gear(s).

In another aspect of the invention, a drive-train assembly for a toy vehicle includes a front gear train and a rear gear train, each include a clutch-gear. The front and rear clutch-gears communicate via a lever such that when the lever is in a first position, the clutch-gears engage with other gears in their respective gear trains and when the lever is in a second position, the clutch-gears disengage from the other gears in their respective gear trains. When the clutch-gears are engaged, the gear trains cooperate to transfer rotational force from one end of the train to the other through the customary operation of gear trains. When the clutch-gears are disengaged, rotational force applied at one or the other ends of the gear trains will not transfer through the gear train because the disengaged clutch-gears break the transfer chain through the train.

Through practice of various aspects of the invention, a toy vehicle can be configured to simply switch from freewheel mode to drive mode and back.

BRIEF DESCRIPTION OF THE SEVERAL VIEWS OF THE DRAWING

These and other features, aspects, and advantages of the present invention will be become better understood with reference to the following description, appended claims, and accompanying drawings where:

DETAILED DESCRIPTION OF THE INVENTION

Figure 1:
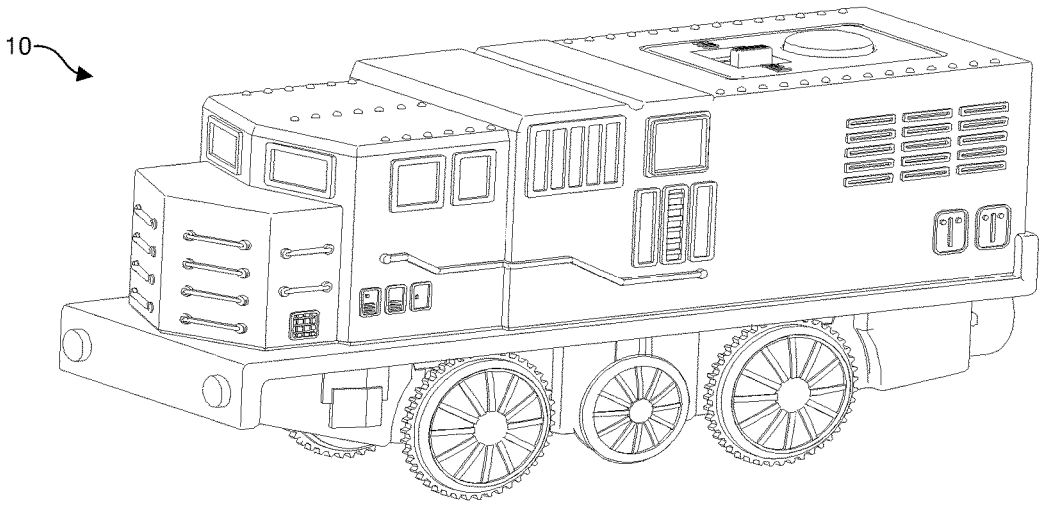
FIG. 1 is a perspective view of an exemplary embodiment of a toy vehicle according to the invention.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

The terms "left" and "right" are used herein to refer to the left-hand side and right-hand side of an observer facing the rear end of a vehicle.

The term "motor-side," in the context of a gear train connecting a motor to wheels, refers to elements of the train that are toward the motor from a reference point. The term "wheel-side," in the context of a gear train connecting a motor to wheels, refers to elements of the train that are toward the wheels from a reference point. For example, a gear, A, in the train may be connected to the motor via two gears, B and C, and to the wheels via a gear, D. Gears B and C are motor-side of gear A and gear D is wheel-side of gear A.

The term "connected to" is used herein to mean either directly or indirectly connected to and includes affixation and simple contact. For example, a wheel is connected to a gear if it is attached to the gear directly or if it is attached to the gear through an axle.

FIG. 1 is a perspective view of an exemplary embodiment of a toy vehicle 10 (a locomotive, in this instance) according to the invention.

Figure 2:
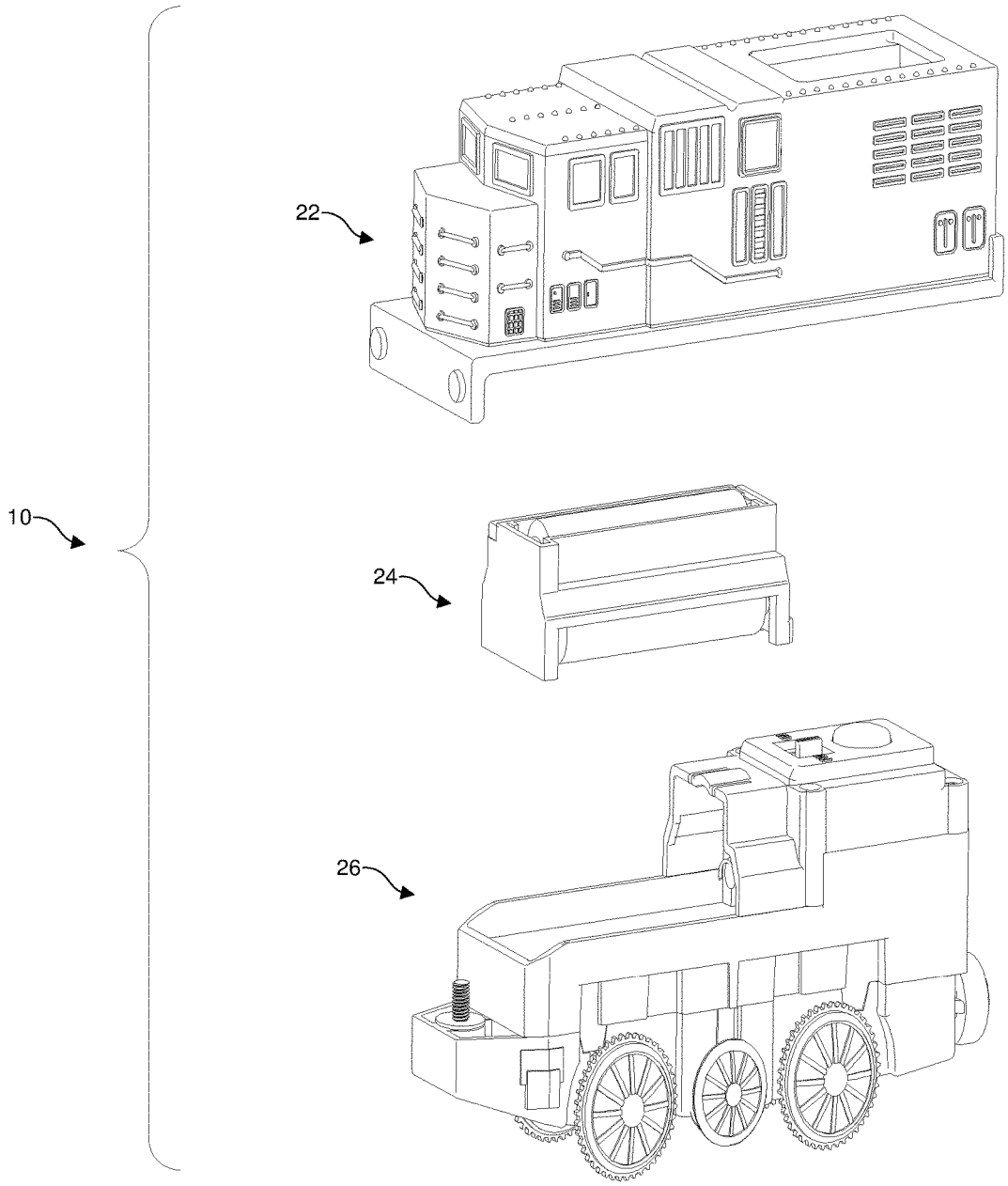
FIG. 2 is an exploded perspective view of an exemplary embodiment of a toy vehicle according to the invention.

FIG. 2 is an exploded perspective view of the toy locomotive 10. The locomotive 10 includes a top cover 22, a battery box 24, and a bottom portion 26.

Figure 3:
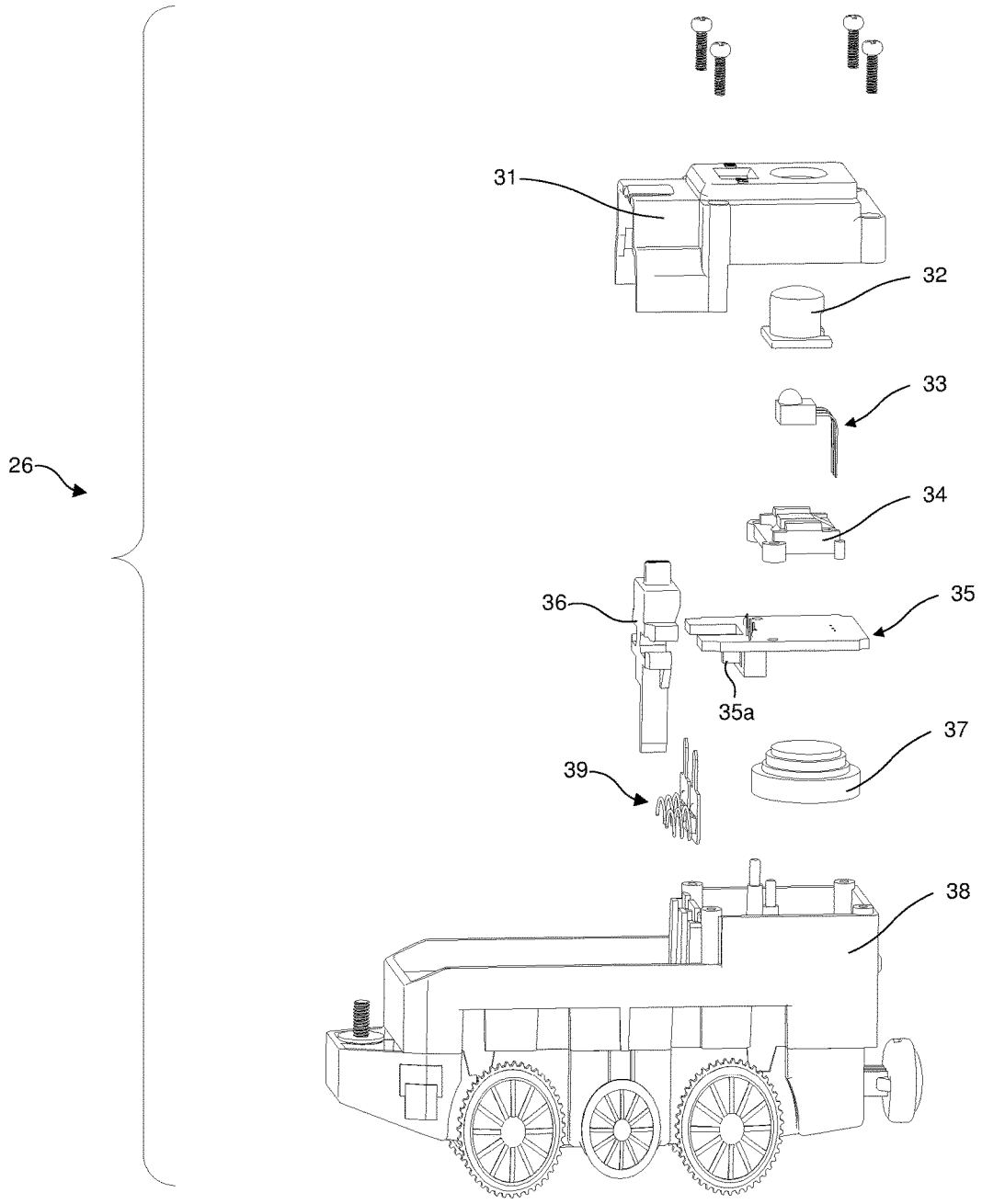
FIG. 3 is an exploded view of a bottom portion of an exemplary embodiment of a toy vehicle according to the invention.

FIG. 3 is a partially exploded perspective view of the bottom portion 26 of the locomotive 10. The bottom portion 26 includes a plastic cover 31, an infrared-receiver cover 32, an infrared receiver 33, an infrared-receiver holder 34, and electronic control board 35 with a mode switch 35*a*, a mode-selector switch 36, a speaker 37, a gear-set cover 38, and a battery-contact-plate 39 with springs.

Figure 4:
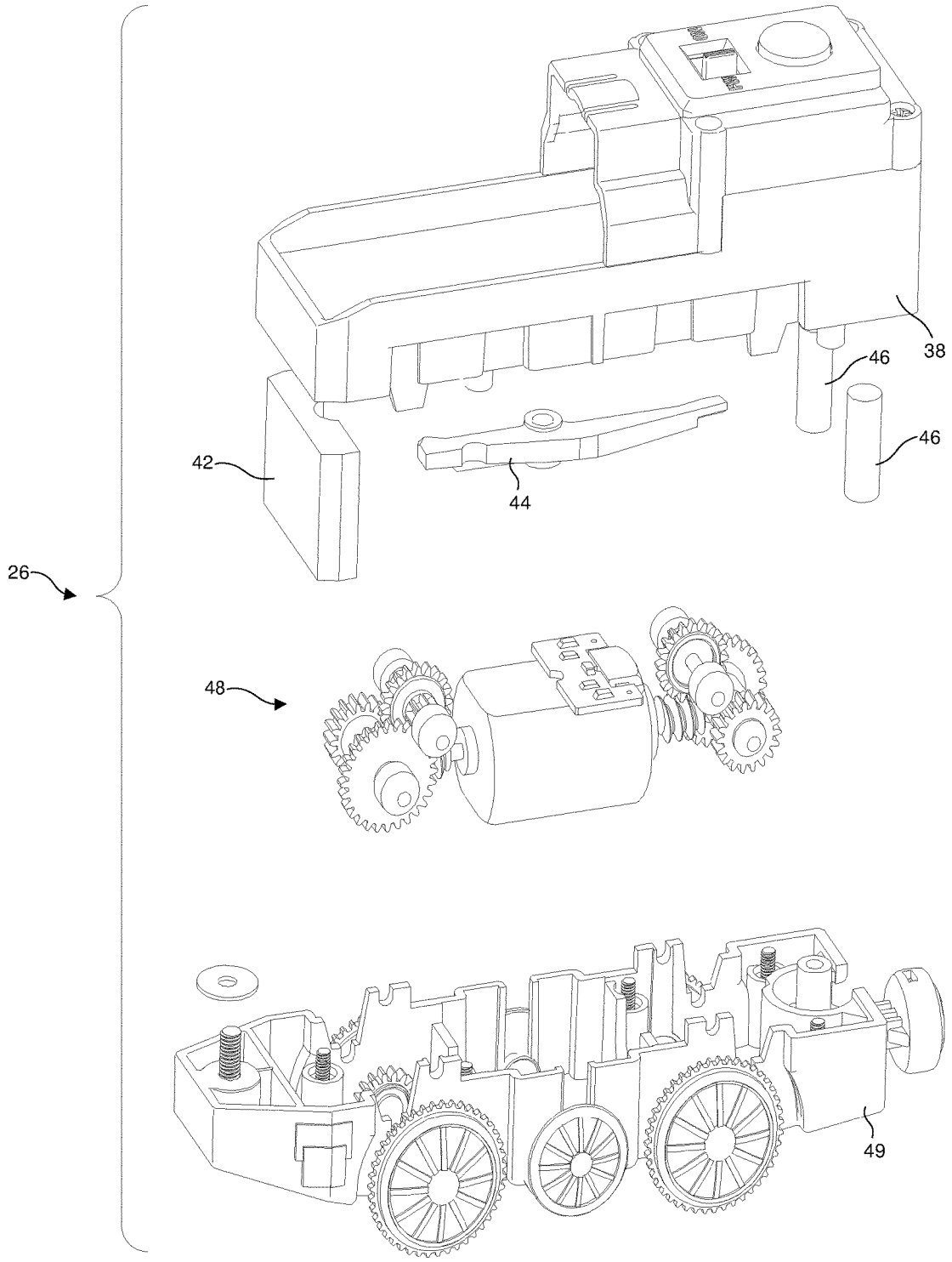
FIG. 4 is an exploded view of a bottom portion of an exemplary embodiment of a toy vehicle according to the invention.

FIG. 4 is another partially exploded perspective view of the bottom portion 26 of the locomotive 10. The bottom portion 26 further includes a weight 42, a mode-selector lever 44, counterweights 46, a gear set 48, and a bottom chassis 49.

Figure 5:
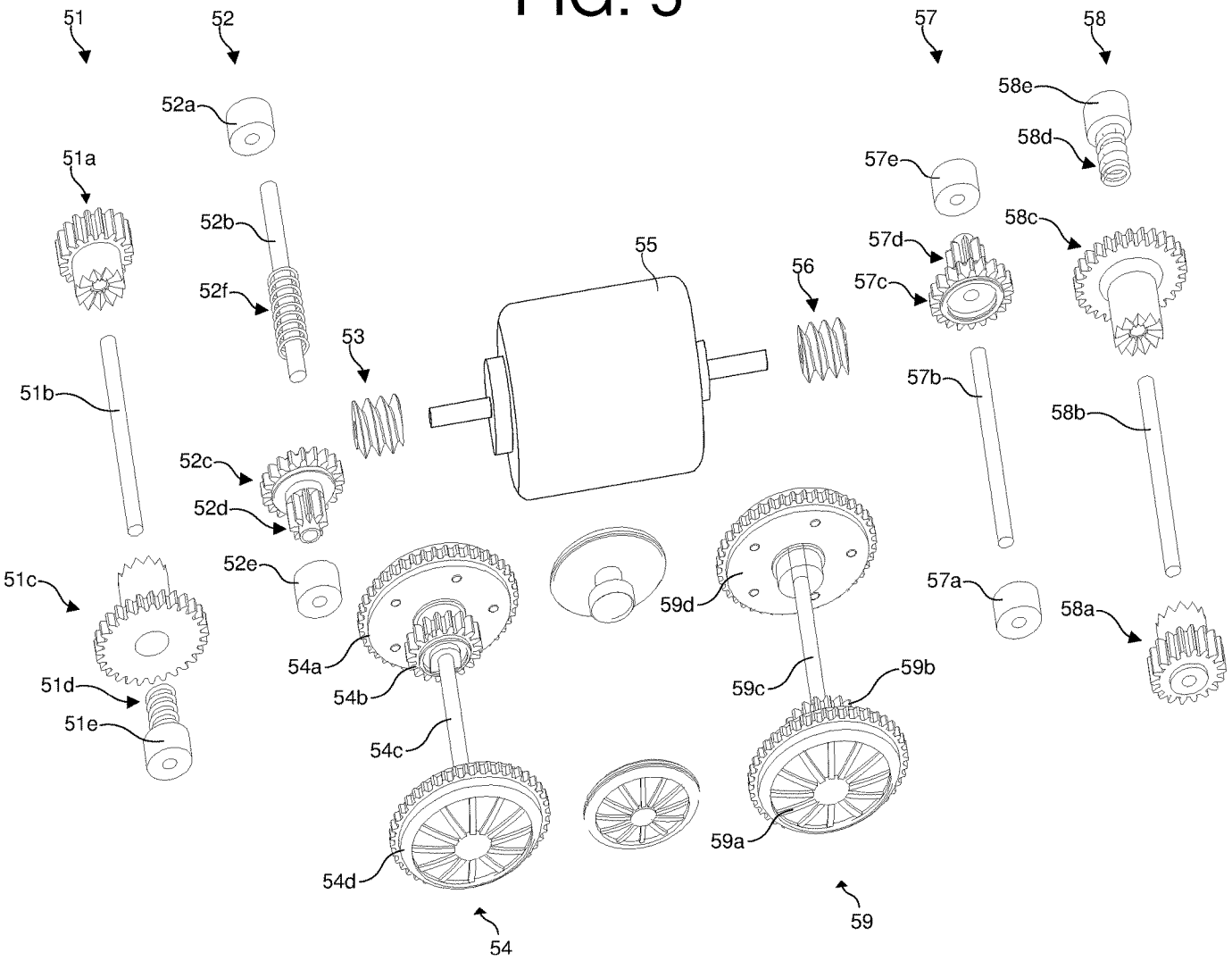
FIG. 5 is an exploded view of an exemplary gear set and wheel assembly according to the invention.

FIG. 5 is an exploded perspective view of the gear set 48 and wheel assemblies 54, 59. The gear set 48 includes a front gear group and a rear gear group. The front gear group includes a front motor gear 53, a first front gear assembly 52, and a second front gear assembly 51. The front gear group drives a front wheel assembly 54. The rear gear group includes a rear motor gear 56, a first rear gear assembly 57, and a second rear gear assembly 58. The rear gear group drives a rear wheel assembly 59.

The first front gear assembly 52 includes a right bushing 52*a*, a metal shaft 52*b*, a reset spring 52*f*, a drive-gear part A 52*c*, a drive-gear part B 52*d*, and a left bushing 52*e*. When assembled in the bottom chassis 49, the reset spring 52*f* pushes the drive gear 52*c*/52*d* toward the left bushing 52*e* and into position such that the drive-gear part A 52*c* meshes with the front motor gear 53. This is the "on" or "drive" position for the front gear group. Drive-gear part A 52*c* and front motor gear 53 together form a worm drive, with the front motor gear 53 acting as the worm (or worm screw) and the drive-gear part A 52*c* acting as the worm gear (or worm wheel). As will be described in more detail, the mode-selector lever 44 may be used to push the drive gear 52*c*/52*d* toward the right bushing 52*a*, compressing the reset spring 52*f* and positioning the drive-gear part A 52*c* such that it does not mesh with the front motor gear 53. This is the "freewheel" position for the front gear group. Thus, the front drive gear 52*c*/52*d* acts as a clutch gear for the gear train of the front gear group in that it may be used to disconnect adjacent gears in the train.

The second front gear assembly 51 includes a protective-gear part A 51*a*, a protective-gear shaft 51*b*, a protective-gear part B 51*c*, a protective spring 51*d*, and a bushing 51*e*. When assembled in the bottom chassis 49, the protective spring 51*d* pushes the protective gear part B 51*c* to mate with the protective-gear part A 51*a* such that the protective-gear part A 51*a* and the protective gear part B 51*c* rotate in concert. If, however, the protective-gear part A 51*a* or the protective-gear part B 51*c* sufficiently resists rotating in concert with the other, the protective-gear part A 51*a* and the protective-gear part B 51*c* will slip apart, compressing safety spring 51*d*. Thus, the second front gear assembly 51 is protected against damage caused by rotation-resistance of the protective-gear part A 51*a* or the protective-gear part B 51*c*. When assembled in bottom chassis 49, the protective-gear part B 51*c* meshes with the drive-gear part B 52*d*.

The front wheel assembly 54 includes a right wheel 54*a*, an output gear 54*b*, an axle 54*c*, and a left wheel 54*d*. When assembled in the bottom chassis 49, protective-gear part A 51*a* meshes with the output gear 54*b*.

The rear gear group and rear wheel assembly can be generally understood with reference to the above description of the front gear group and front wheel assembly. The first rear gear assembly 57 includes a left bushing 57*a*, a metal shaft 57*b*, a drive-gear part A 57*c*, a drive-gear part B 57*d*, and a left bushing 57*e*. The second rear gear assembly 58 includes a protective-gear part A 58*a*, a protective-gear shaft 58*b*, a protective-gear part B 58*c*, a protective spring 58*d*, and a bushing 58*e*. The rear wheel assembly 59 includes a left wheel 59*a*, an output gear 59*b*, an axle 59*c*, and a right wheel 59*d*. When assembled in the bottom chassis 49, the rear output gear 59*b* meshes with the rear protective-gear part A 58*a*, the rear protective-gear part B 58*c* meshes with the rear drive-gear part B 57*d*, and the rear drive-gear part A 57*c* selectively meshes with rear motor gear 56 as selected by the mode-selector switch 36.

Figure 6A:
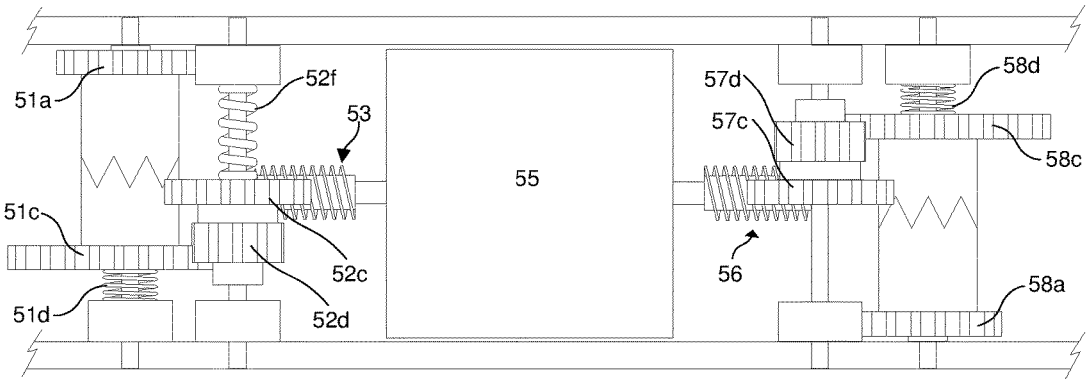
FIG. 6*a* is a top view of a drive-configured exemplary gear set according to the invention.
Figure 6B:
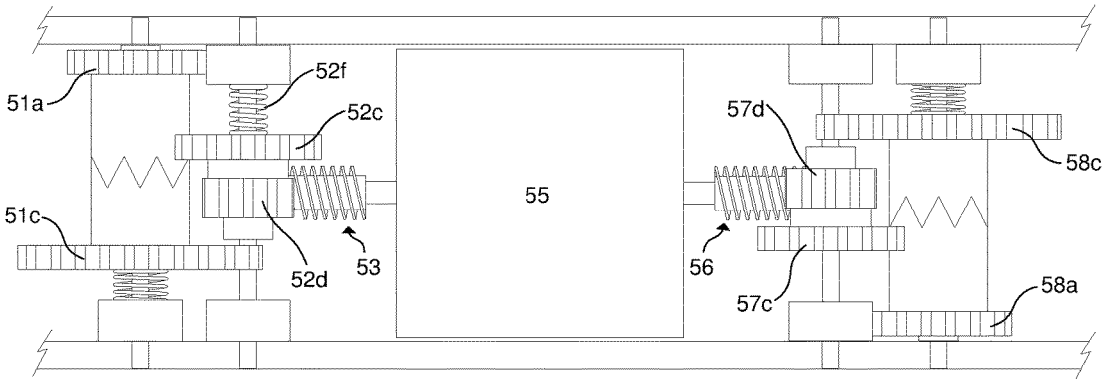
FIG. 6*b* is a top view of a freewheel-configured exemplary gear set according to the invention.

FIGS. 6*a*-6*b* are top views of the gear set 48 illustrating the gear set 48 in the "on" (or "drive") position (FIG. 6*a*) and in the "freewheel" position (FIG. 6*b*).

In the "on" position, the motor 55 drives (rotates) the front motor gear 53 and the rear motor gear 56 (as controlled by an infrared remote). The front motor gear 53 meshes with and drives the front drive-gear part A 52*c* which is connected to the front drive-gear part B 52*d*. The front drive-gear part B 52*d* meshes with and drives the front protective-gear part B 51*c* which is connected to the front protective-gear part A 51*a*. The front protective-gear part A 51*a* meshes with and drives the front output gear 54*b* which is connected to the front wheels 54*a*, 54*d*. Thus, rotation of the front motor gear 53 rotates the front wheels 54*a*, 54*d*. The rear motor gear 56 meshes with and drives the rear drive-gear part A 57*c* which is connected to the rear drive-gear part B 57*d*. The rear drive-gear part B 57*d* meshes with and drives the rear protective-gear part B 58*c* which is connected to the rear protective-gear part A 58*a*. The rear protective-gear part A 58*a* meshes with and drives the rear output gear 59*b* which is connected to the rear wheels 59*a*, 59*d*. Thus, rotation of the rear motor gear 56 rotates the rear wheels 59*a*, 59*d*. In this "on" configuration, control of the motor 55 to rotate the front motor gear 53 and the rear motor gear 56 controls rotation of the front wheels 54*a*, 54*d* and the rear wheels 59*a*, 59*d*.

In the "freewheel" position, as in the "on" position, the front output gear 54*b* and the rear output gear 59*b* mesh with the front protective-gear part A 51*a* and the rear protective-gear part A 58*a*, respectively. The front drive gear 52*c*/52*d* and the rear drive gear 57*c*/57*d*, however, are repositioned so that the front drive gear 52*c*/52*d* does not mesh with the front motor gear 53 or the front protective-gear part B 51*c* and so that the rear drive gear 57*c*/57*d* does not mesh with the rear motor gear 56 or the rear protective-gear part B 58*c*. Thus, the wheels 54*a*, 54*d*, 59*a*, 59*d* rotate freely and independently of the motor gears 53, 56. In this "freewheel" configuration, rotating the wheels 54*a*, 54*d*, 59*a*, 59*d* by, for example, pushing the vehicle 10 along a surface (e.g., floor or table), will not result in any forced rotation of the motor gears 53, 56. The motor 55 will not resist or prevent such use of the vehicle 10—and it will not be damaged by such use.

Figure 7A:
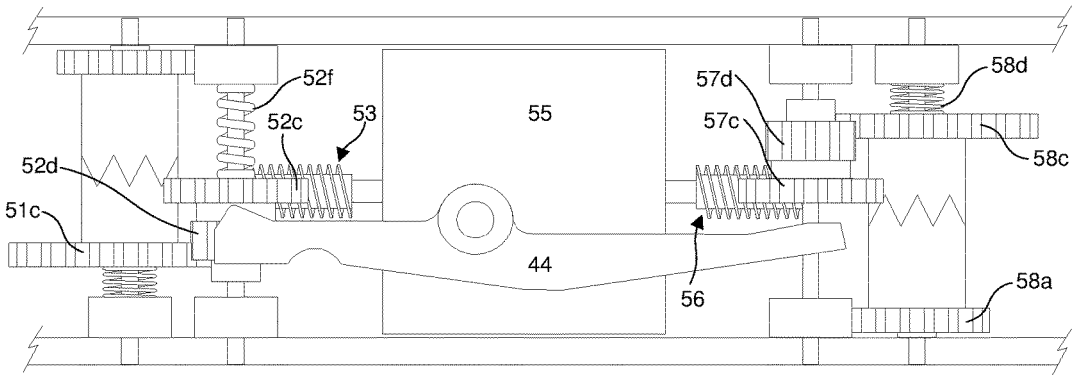
FIG. 7*a* is a top view of a drive-configured exemplary gear set and mode-selector lever according to the invention.
Figure 7B:
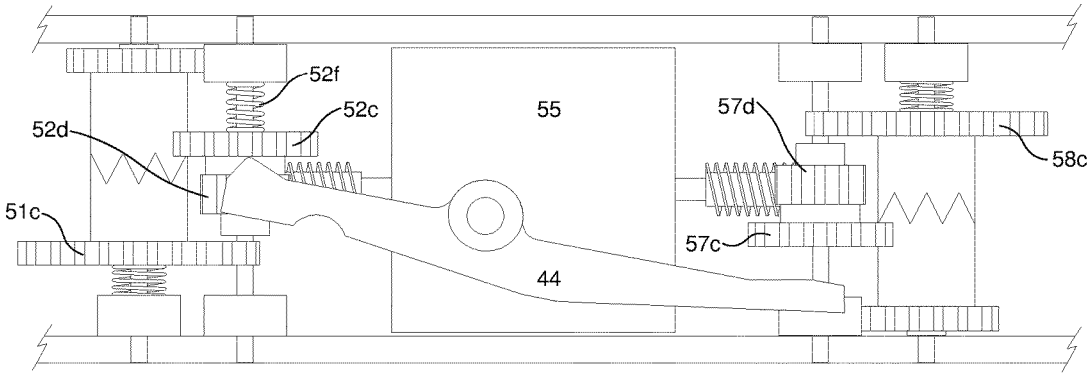
FIG. 7*b* is a top view of a freewheel-configured exemplary gear set and mode-selector lever according to the invention.

FIGS. 7*a*-7*b* are top views of the gear set 48 and mode-selector lever 44 illustrating the gear set 48 in the "on" position (FIG. 7*a*) and in the "freewheel" position (FIG. 7*b*). The mode-selector lever 44 is mounted to pivot such that the front end of the mode-selector lever 44 moves to the right when the rear end of the mode-selector lever 44 moves to the left. In FIG. 7*a*, the mode-selector lever 44 is shown in the "on" position: the front end of the mode-selector lever 44 is pushed to the left by the reset spring 52*f*. In FIG. 7*b*, the mode-selector lever 44 is shown in the "freewheel" position: the rear end of the mode-selector lever 44 has been pushed to the left by the mode-selector switch 36 (a as will be explained in more detail), causing the front end of the mode-selector lever 44 to move to the right. The mode-selector switch 36 is not shown in FIGS. 7*a*-7*b* for sake of clarity.

Figure 8A:
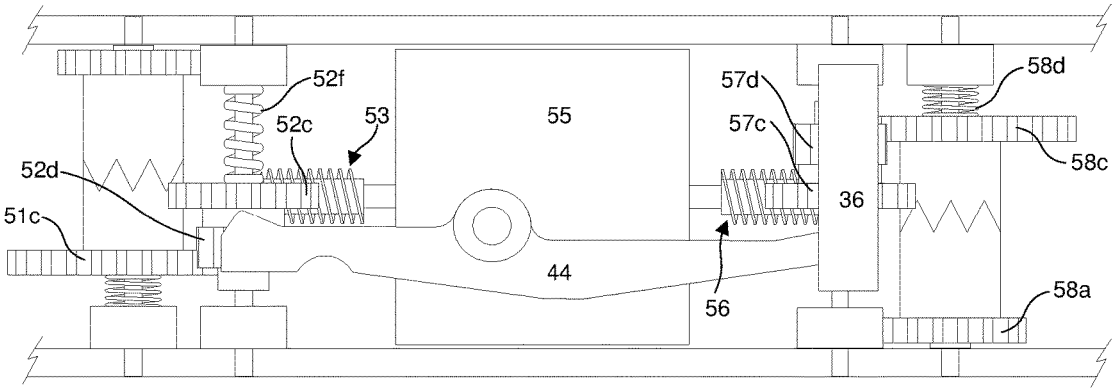
FIG. 8*a* is a top view of a drive-configured exemplary gear set, mode-selector lever, and mode-selector switch according to the invention.
Figure 8B:
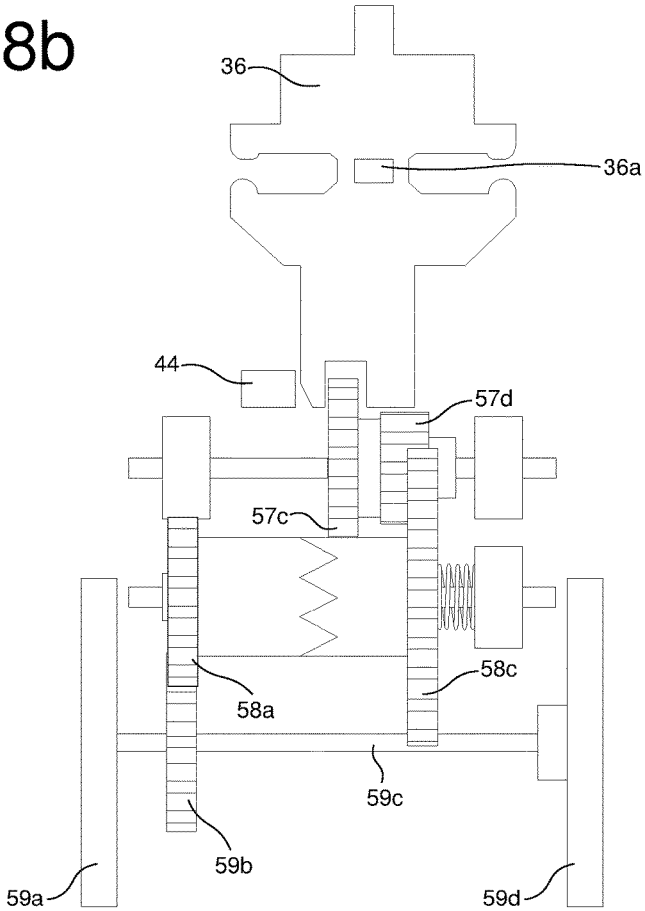
FIG. 8*b* is a back view of a drive-configured exemplary gear set, wheel assembly, mode-selector lever, and mode-selector switch according to the invention.

FIGS. 8*a*-8*b* illustrate the gear set 48, rear wheel assembly 59, mode-selector lever 44, and mode-selector switch 36 in the "on" position. FIG. 8*a* is almost identical to FIG. 7*a* with the difference being that FIG. 8*a* also depicts the mode-selector switch 36. The wheel assemblies 54, 59 are omitted from FIG. 8*a* for the sake of clarity. FIG. 8*b* is a rear view of the rear gear group, the rear wheel assembly, the mode-selector lever 44, and the mode-selector switch 36. The mode-selector switch 36 is configured to fit over the top portion of rear drive-gear part A 57*c* and to abut the rear end of the mode-selector lever 44. Mode-selector switch 36 can move translationally between a right position ("on") and a left position ("freewheel"). The mode-selector switch 36 may include a feature 36*a* to engage the switch 35*a* on the electronic control board 35 (shown in FIG. 3) and thus enable power or infrared-remote operation in the "on" position and disable power or infrared-remote operation in the "freewheel" position. When, as shown in FIGS. 8*a*-8*b*, the mode-selector switch 36 is placed in the right position, the rear drive gear 57*c*/57*d* is positioned so that the rear drive-gear part A 57*c* meshes with the rear motor gear 56 and so that the rear drive-gear part B 57*d* meshes with the rear protective-gear part B 58*c*. Also as shown in FIGS. 8*a*-8*b*, when the mode-selector switch 36 is in the right position, reset spring 52*f* forces the rear end of mode-selector lever 44 in the right position and the front end of mode-selector lever 44 in the left position. As a result, when the mode-selector switch 36 is in the right ("on") position, front motor gear 53 meshes with front drive-gear part A 52*c* and front drive-gear part B 52*d* meshes with front protective-gear part B 51*c*.

Figure 9A:
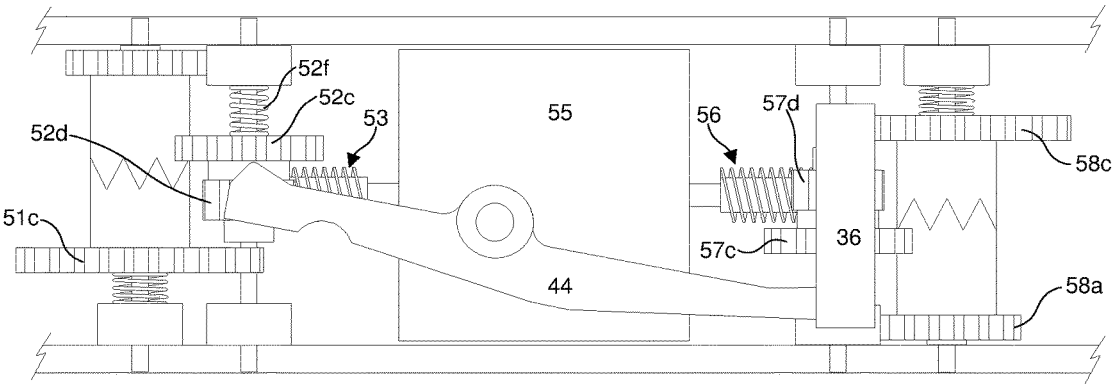
FIG. 9*a* is a top view of a freewheel-configured exemplary gear set, mode-selector lever, and mode-selector switch according to the invention.
Figure 9B:
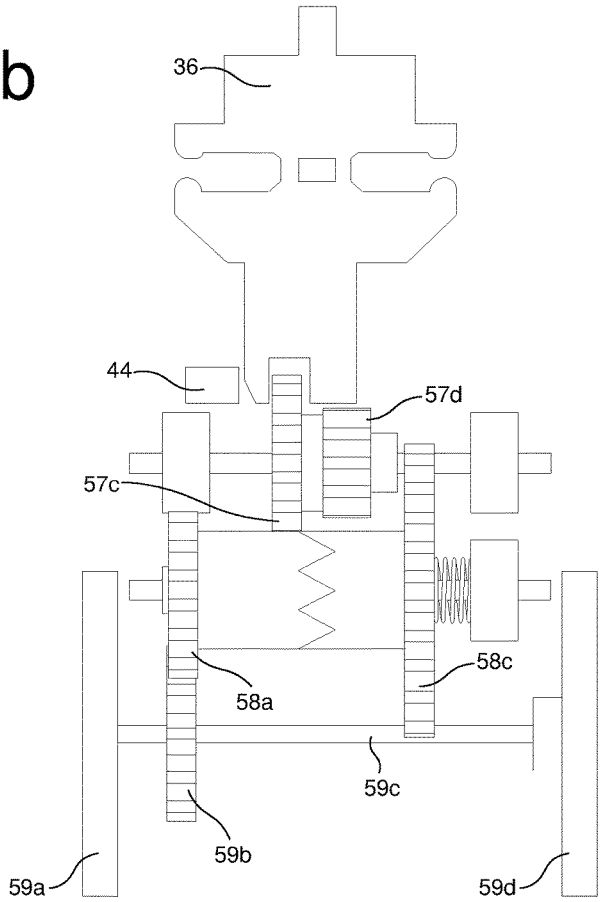
FIG. 9*b* is a back view of a freewheel-configured exemplary gear set, wheel assembly, mode-selector lever, and mode-selector switch according to the invention.

FIGS. 9*a*-9*b* illustrate the gear set 48, rear wheel assembly 59, mode-selector lever 44, and mode-selector switch 36 in the "freewheel" position. FIG. 9*a* is almost identical to FIG. 7*b* with the difference being that FIG. 9*a* also depicts the mode-selector switch 36. The wheel assemblies 54, 59 are omitted from FIG. 9*a* for the sake of clarity. FIG. 9*b* is a rear view of the rear gear group, the rear wheel assembly 59, the mode-selector lever 44, and the mode-selector switch 36. When, as shown in FIGS. 9*a*-9*b*, the mode-selector switch 36 is placed in the left position, the rear drive gear 57*c*/57*d* is positioned so that the rear drive-gear part A 57*c* does not mesh with the rear motor gear 56 and so that the rear drive-gear part B 57*d* does not mesh with the rear protective-gear part B 58*c*. Also as shown in FIGS. 9*a*-9*b*, when the mode-selector switch 36 is in the left position, the rear end of mode-selector lever 44 is moved to the left, causing the front end of mode-selector lever 44 to move to the right which moves the front drive gear 52*c*/52*d* to the right and compresses the reset spring 52*f*. As a result, when the mode-selector switch 36 is in the left ("freewheel") position, the front motor gear 53 does not mesh with the front drive-gear part A 52*c* and the front drive-gear part B 52*d* does not mesh with the front protective-gear part B 51*c*.

Figure 10A:
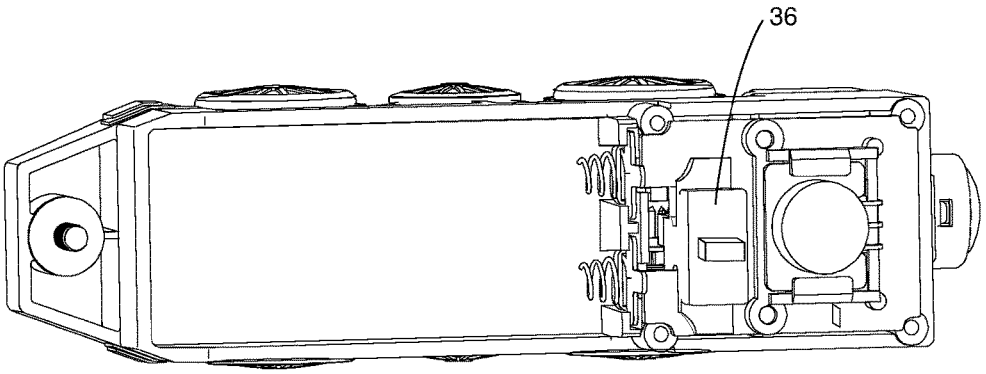
FIG. 10*a* is a top perspective view of a top-cover of a bottom portion of an exemplary embodiment of a toy vehicle according to the invention.
Figure 10B:
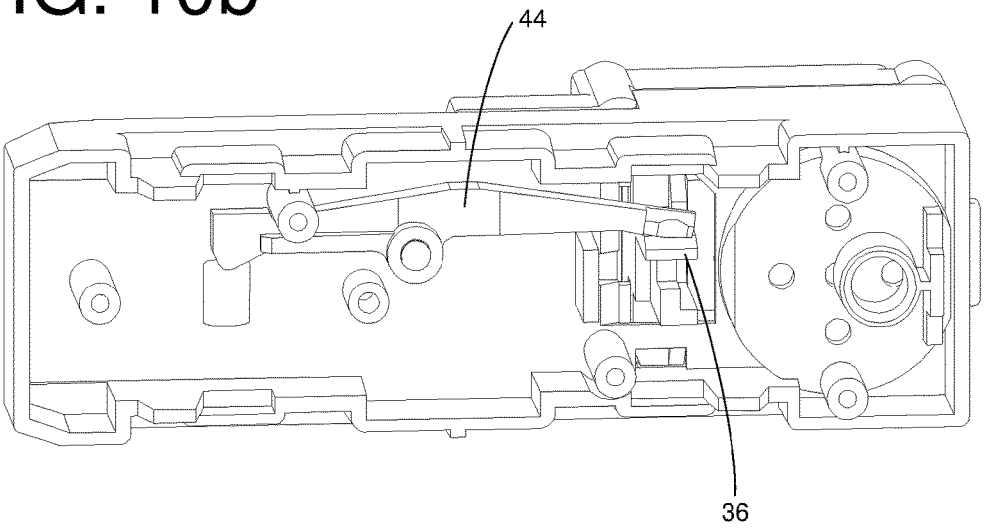
FIG. 10*b* is a bottom perspective view of a top cover of a bottom portion of an exemplary embodiment of a toy vehicle according to the invention.

FIGS. 10*a*-10*b* are, respectively, top and bottom perspective views of the gear-set cover 38 with the mode-selector switch 36 and mode-selector lever 44.

Figure 11A:
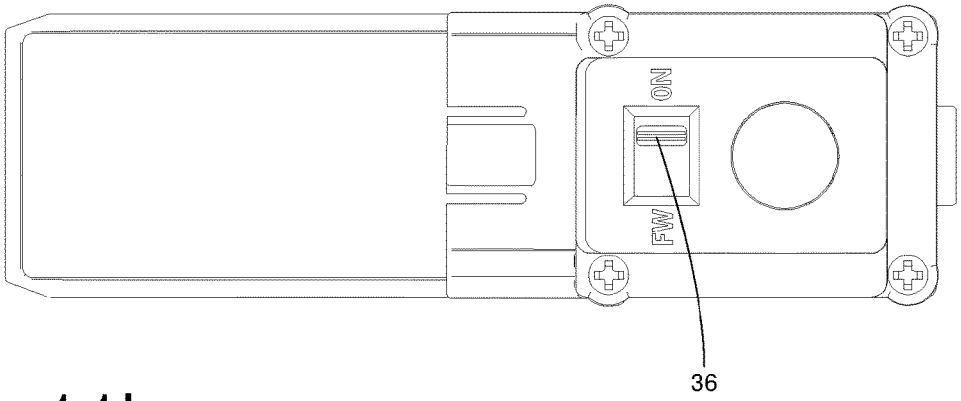
FIGS. 11*a*-11*c* are various views of a drive-configured gear set, wheel assembly, mode-selector lever, and mode-selector switch of an exemplary embodiment of a toy vehicle according to the invention.
Figure 11B:
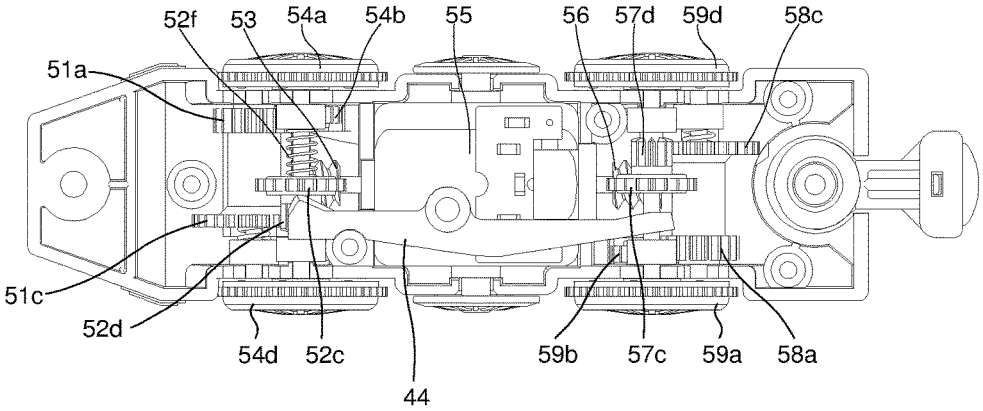
Figure 11C:
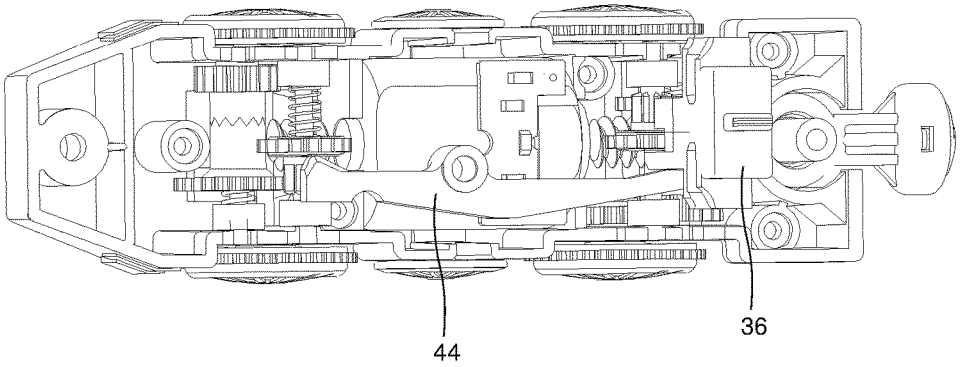

FIGS. 11*a*-11*c* are various views of portions of the exemplary toy vehicle 10 in the "on" position. FIG. 11*a* is a top view of the gear-set cover 38 showing the mode-selector switch 36 in the "on" position. FIG. 11*b* is a top view of the gear set 48, wheel assemblies 54, 59, and mode-selector lever 44 as configured in the "on" position. The mode-selector switch 36 is omitted for sake of clarity. FIG. 11*c* is a top perspective view of the gear set 48, wheel assemblies 54, 59, mode-selector lever 44, and mode-selector switch 36 as configured in the "on" position.

Figure 12A:
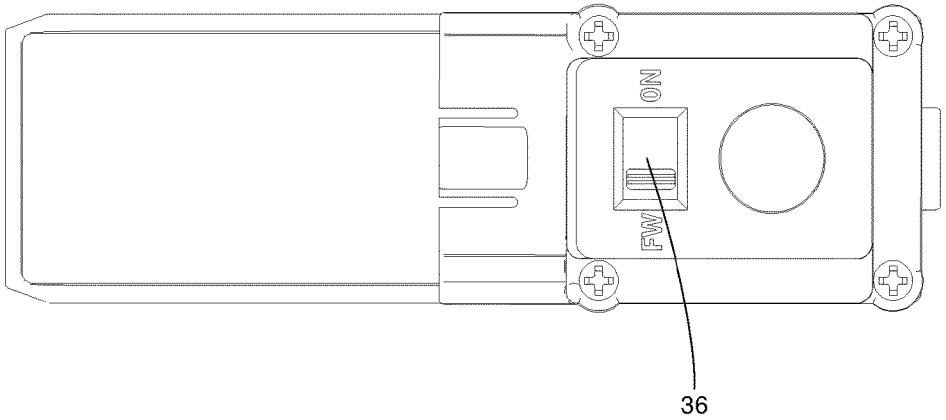
FIGS. 12*a*-12*c* are various views of a freewheel-configured gear set, wheel assembly, mode-selector lever, and mode-selector switch of an exemplary embodiment of a toy vehicle according to the invention.
Figure 12B:
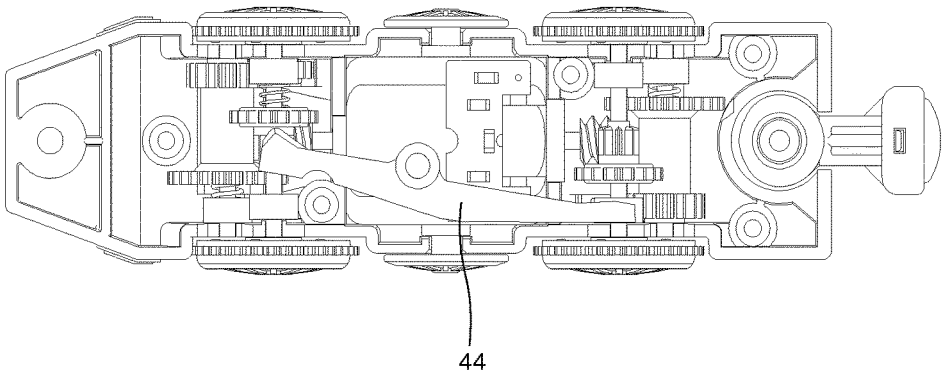
Figure 12C:
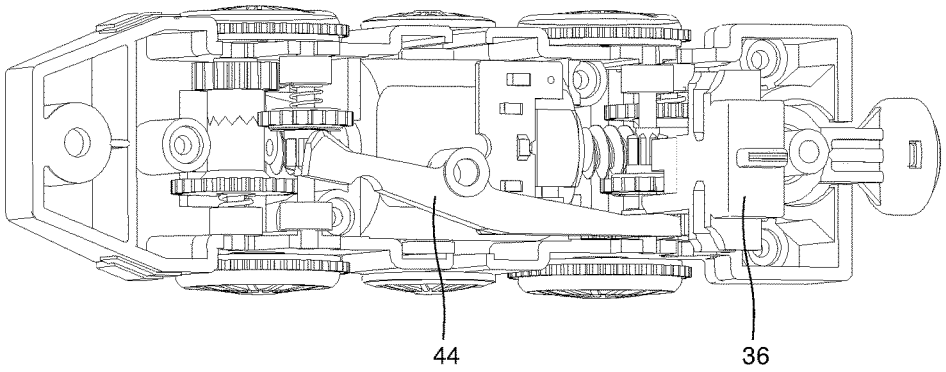

FIGS. 12*a*-12*c* are various views of portions of the exemplary toy vehicle 10 in the "freewheel" position. FIG. 12*a* is a top view of the gear-set cover 38 showing the mode-selector switch 36 in the "freewheel" (FW) position. FIG. 12*b* is a top view of the gear set 48, wheel assemblies 54, 59, and mode-selector lever 44 as configured in the "freewheel" position. The mode-switch lever 36 is omitted for sake of clarity. FIG. 12*c* is a top perspective view of the gear set 48, wheel assemblies 54, 59, mode-selector lever 44, and mode-selector switch 36 as configured in the "freewheel" position.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A toy vehicle comprising:

(a) a chassis;

(b) an electric motor mounted on the chassis, the electric motor having a first shaft and a second shaft;

(c) a first motor gear connected to the first shaft of the electric motor such that the first motor gear rotates when the first shaft of the electric motor rotates;

(d) a first drive-gear assembly mounted on the chassis, the first drive-gear assembly comprising:

(i) a first motor-side drive gear configured to be selectively meshed with the first motor gear such that, when meshed, the first motor-side drive gear rotates when the first motor gear rotates; and (ii) a first wheel-side drive gear connected to the first motor-side drive gear such that the first wheel-side drive gear rotates when the first motor-side drive gear rotates;

(e) a first protective-gear assembly mounted on the chassis, the first protective-gear assembly comprising:

(i) a first motor-side protective gear configured to be selectively meshed with the first wheel-side drive gear such that, when meshed, the first motor-side protective gear rotates when the first wheel-side drive gear rotates; and (ii) a first wheel-side protective gear connected to the first motor-side protective gear such that the first wheel-side protective gear rotates when the first motor-side protective gear rotates;

(f) a first wheel assembly mounted on the chassis, the first wheel assembly comprising:

(i) a first left wheel;

(ii) a first right wheel; and (iii) a first output gear: (a) connected to at least one of the first right wheel or the first left wheel such that at least one of the first right wheel or the first left wheel rotates when the first output gear rotates and (b) meshed with the first wheel-side protective gear such that the first output gear rotates when the first wheel-side protective gear rotates;

(g) a second motor gear connected to the second shaft of the electric motor such that the second motor gear rotates when the second shaft of the electric motor rotates;

(h) a second drive-gear assembly mounted on the chassis, the second drive-gear assembly comprising:

(i) a second motor-side drive gear configured to be selectively meshed with the second motor gear such that, when meshed, the second motor-side drive gear rotates when the second motor gear rotates; and (ii) a second wheel-side drive gear connected to the second motor-side drive gear such that the second wheel-side drive gear rotates when the second motor-side drive gear rotates;

(i) a second protective-gear assembly mounted on the chassis, the second protective-gear assembly comprising:

(i) a second motor-side protective gear configured to be selectively meshed with the second wheel-side drive gear such that, when meshed, the second motor-side protective gear rotates when the second wheel-side drive gear rotates; and (ii) a second wheel-side protective gear connected to the second motor-side protective gear such that the second wheel-side protective gear rotates when the second motor-side protective gear rotates;

(j) a second wheel assembly mounted on the chassis, the second wheel assembly comprising:

(i) a second left wheel;

(ii) a second right wheel; and (iii) a second output gear: (a) connected to at least one of the second right wheel or the second left wheel such that at least one of the second right wheel or the second left wheel rotates when the second output gear rotates and (b) meshed with the second wheel-side protective gear such that the second output gear rotates when the second wheel-side protective gear rotates;

(k) a mode-selector switch configured to move the second motor-side drive gear and the second wheel-side drive gear such that: (i) in a first mode-selector-switch position, the second motor-side drive gear is meshed with the second motor gear and the second wheel-side drive gear is meshed with the second motor-side protective gear, and (ii) in a second mode-selector-switch position, the second motor-side drive gear is not meshed with the second motor gear and the second wheel-side drive gear is not meshed with the second motor-side protective gear; and (l) a mode-selector lever configured to contact the first drive-gear assembly and at least one of the mode-selector switch and second drive-gear assembly and further configured to move the first motor-side drive gear and the first wheel-side drive gear according to the mode-selector-switch position such that: (i) in the first mode-selector-switch position, the first motor-side drive gear is meshed with the first motor gear and the first wheel-side drive gear is meshed with the first motor-side protective gear, and (ii) in a second mode-selector-switch position, the first motor-side drive gear is not meshed with the first motor gear and the first wheel-side drive gear is not meshed with the first motor-side protective gear.

2. The toy vehicle of claim 1 further comprising a reset spring configured to exert a force on the mode-selector lever sufficient to: (a) place the mode-selector lever in position so that the first motor-side drive gear is meshed with the first motor gear and the first wheel-side drive gear is meshed with the first motor-side protective gear when the mode-selector switch is in the first mode-selector-switch position, and (b) allow the mode-selector lever to be positioned so that the first motor-side drive gear is not meshed with the first motor gear and the first wheel-side drive gear is not meshed with the first motor-side protective gear when the mode-selector switch is in the second mode-selector-switch position.

3. The toy vehicle of claim 1 further comprising a reset spring configured to exert a force on the mode-selector lever sufficient to: (a) place the mode-selector lever in position so that the first motor-side drive gear is not meshed with the first motor gear and the first wheel-side drive gear is not meshed with the first motor-side protective gear when the mode-selector switch is in the second mode-selector-switch position, and (b) allow the mode-selector lever to be positioned so that the first motor-side drive gear is meshed with the first motor gear and the first wheel-side drive gear is meshed with the first motor-side protective gear the mode-selector switch is in the first mode-selector-switch position.

4. The toy vehicle of claim 1, the first protective-gear assembly further comprising:

(a) a first protective spring placed to exert a spring-based force to connect the first wheel-side protective gear and the first motor-side protective gear such that the first wheel-side protective gear rotates when the first motor-side protective gear rotates;

(b) wherein the connection between the first wheel-side protective gear and the first motor-side protective gear is configured such that: (i) rotation of the first wheel-side protective gear or the first motor-side protective gear exerts a rotation-based force opposite the spring-based force exerted by the first protective spring, and (ii) when the rotation-based force exceeds the spring-based force, the connection will slip and the first wheel-side protective gear will not rotate when the first motor-side protective gear rotates and the first motor-side protective gear will not rotate when the first wheel-side protective gear rotates.

5. The toy vehicle of claim 1, the second protective-gear assembly further comprising:

(a) a second protective spring placed to exert a spring-based force to connect the second wheel-side protective gear and the second motor-side protective gear such that the second wheel-side protective gear rotates when the second motor-side protective gear rotates;

(b) wherein the connection between the second wheel-side protective gear and the second motor-side protective gear is configured such that: (i) rotation of the second wheel-side protective gear or the second motor-side protective gear exerts a rotation-based force opposite the spring-based force exerted by the second protective spring, and (ii) when the rotation-based force exceeds the spring-based force, the connection will slip and the second wheel-side protective gear will not rotate when the second motor-side protective gear rotates and the second motor-side protective gear will not rotate when the second wheel-side protective gear rotates.

6. The toy vehicle of claim 1 further comprising a wireless receiver to receive one or more wireless signals, wherein the wireless receiver is electronically coupled to the electric motor.

7. The toy vehicle of claim 6 wherein the shaft-rotation direction of the electric motor is a function of the wireless signals received by the wireless receiver.

8. The toy vehicle of claim 6 wherein the shaft-rotation speed of the electric motor is a function of the wireless signals received by the wireless receiver.

9. The toy vehicle of claim 1 further comprising a power supply, wherein the mode-selector switch is further configured to connect the electric motor to the power supply in the first mode-selector-switch position and to disconnect the electric motor from the power supply in the second mode-selector-switch position.

10. A toy vehicle comprising:

(a) a chassis;

(b) an electric motor mounted on the chassis;

(c) front wheels mounted on the chassis;

(d) rear wheels mounted on the chassis;

(e) a means for: (i) selectively connecting the motor to the front wheels and to the rear wheels to place the toy vehicle in a drive position, and (ii) selectively disconnecting the motor from the front wheels and from the rear wheels to place the toy vehicle in a freewheel position; and (f) a means for protecting the front wheels and motor from damage due to forcible rotation of the front wheels when in the drive position.

11. A toy vehicle comprising:

(a) a chassis;

(b) an electric motor mounted on the chassis;

(c) front wheels mounted on the chassis;

(d) rear wheels mounted on the chassis;

(e) a means for: (i) selectively connecting the motor to the front wheels and to the rear wheels to place the toy vehicle in a drive position, and (ii) selectively disconnecting the motor from the front wheels and from the rear wheels to place the toy vehicle in a freewheel position; and (f) a means for protecting the rear wheels and motor from damage due to forcible rotation of the rear wheels when in the drive position.

* * * * *